US010562661B2

(12) United States Patent
Cooper

(10) Patent No.: US 10,562,661 B2
(45) Date of Patent: Feb. 18, 2020

(54) DISPLAY TRAY WITH SUPPORT COLUMN AND APERTURES

(71) Applicant: Mars, Incorporated, McLean, VA (US)

(72) Inventor: Derek Cooper, Slough (GB)

(73) Assignee: Mars, Incorporated, McLean, VA (US)

( * ) Notice: Subject to any disclaimer, the term of this patent is extended or adjusted under 35 U.S.C. 154(b) by 47 days.

(21) Appl. No.: 15/503,343

(22) PCT Filed: Aug. 13, 2015

(86) PCT No.: PCT/US2015/045116

§ 371 (c)(1),
(2) Date: Feb. 10, 2017

(87) PCT Pub. No.: WO2016/025748

PCT Pub. Date: Feb. 18, 2016

(65) Prior Publication Data

US 2017/0267397 A1 Sep. 21, 2017

(30) Foreign Application Priority Data

Aug. 13, 2014 (GB) ..... 1414358.0

(51) Int. Cl.
*B65D 5/52* (2006.01)
*B65D 5/00* (2006.01)
(Continued)

(52) U.S. Cl.
CPC ..... *B65D 5/5286* (2013.01); *A47F 5/114* (2013.01); *B31B 50/60* (2017.08); *B31B 50/74* (2017.08);
(Continued)

(58) Field of Classification Search
CPC ..... A47F 5/114; B65D 5/5286; B65D 5/0045; B65D 5/20; B65D 5/4266; B65D 5/443;
(Continued)

(56) References Cited

U.S. PATENT DOCUMENTS 1,486,145 A 3/1924 Johnson
2,375,843 A 5/1945 Gottlieb
(Continued)

FOREIGN PATENT DOCUMENTS

CH 539548 A 7/1973
CH 671383 8/1989
(Continued)

OTHER PUBLICATIONS

CN First Office Action for App No. CN 201580043273, dated Jun. 5, 2018 (11 pages).
(Continued)

*Primary Examiner* — Christopher R Demeree
(74) *Attorney, Agent, or Firm* — Fish & Richardson P.C.

(57) ABSTRACT

An apparatus to display packaged products that includes a base that includes a bottom segment, at least two supporting segments, and a top segment, the top segment provided with a plurality of apertures and supported at least in part by the at least two supporting segments such that the bottom segment and the top segment are generally parallel; and at least two side portions, at least one of said side portions comprising a support column, the at least two side portions being generally perpendicular to the bottom segment and the top segment. Methods of assembling the apparatus are also provided.

20 Claims, 8 Drawing Sheets

(51) Int. Cl.

| | |
|---|---|
| ***B65D 5/42*** | (2006.01) |
| ***B65D 5/486*** | (2006.01) |
| ***B65D 5/44*** | (2006.01) |
| ***B65D 5/64*** | (2006.01) |
| ***B65D 5/20*** | (2006.01) |
| ***A47F 5/11*** | (2006.01) |
| ***B65D 5/50*** | (2006.01) |
| ***B31B 50/60*** | (2017.01) |
| ***B31B 50/74*** | (2017.01) |
| ***B65D 5/468*** | (2006.01) |
| *B31B 100/00* | (2017.01) |
| *B31B 50/26* | (2017.01) |
| *B31B 50/81* | (2017.01) |
| *B31B 50/62* | (2017.01) |
| *B31B 120/00* | (2017.01) |

(52) U.S. Cl.
CPC ..... *B65D 5/0045* (2013.01); *B65D 5/20* (2013.01); *B65D 5/4266* (2013.01); *B65D 5/443* (2013.01); *B65D 5/4608* (2013.01); *B65D 5/5021* (2013.01); *B65D 5/64* (2013.01); *B31B 50/26* (2017.08); *B31B 50/62* (2017.08); *B31B 50/81* (2017.08); *B31B 2100/00* (2017.08); *B31B 2120/502* (2017.08)

(58) Field of Classification Search
CPC ..... B65D 5/4608; B65D 5/5021; B65D 5/64; B65D 5/5038; B65D 5/22; B65D 5/002; B65D 5/5061; B31B 3/26; B31B 3/60; B31B 3/74
USPC ..... 229/191, 918, 241, 904; 206/590, 763, 206/485, 589
See application file for complete search history.

(56) References Cited

U.S. PATENT DOCUMENTS

| | | | | |
|---|---|---|---|---|
| 2,867,048 | A | 1/1959 | Holtzman | |
| 3,390,783 | A * | 7/1968 | Quackenbush, Jr. | B01L 9/06 211/73 |
| 4,883,221 | A | 11/1989 | Brundage | |
| D315,297 | S * | 3/1991 | Campbell | D9/721 |
| 5,294,044 | A | 3/1994 | Clark | |
| 5,535,941 | A | 7/1996 | Garza | |
| 5,649,663 | A | 7/1997 | Pestow, Jr. | |
| 6,257,484 | B1 | 7/2001 | Dowd | |
| 7,007,837 | B2 | 3/2006 | Correll | |
| 7,628,312 | B2 * | 12/2009 | Mittelstaedt | B65D 5/2057 229/120.36 |
| 9,446,623 | B2 * | 9/2016 | Black | B44D 3/00 |
| 9,533,791 | B2 * | 1/2017 | Fath | B65D 5/425 |
| 2006/0289334 | A1 | 12/2006 | Lechelle et al. | |

FOREIGN PATENT DOCUMENTS

| | | | |
|---|---|---|---|
| DE | 1097351 | B | 1/1961 |
| DE | 8217418 | U1 | 7/1983 |
| DE | 202013004281 | U1 | 8/2013 |
| EP | 1627818 | | 2/2006 |
| EP | 1992564 | | 11/2008 |
| EP | 1746034 | | 1/2009 |
| EP | 1746035 | | 4/2010 |
| EP | 2277785 | | 1/2011 |
| FR | 483933 | | 8/1917 |
| FR | 2025106 | | 9/1970 |
| FR | 2198456 | | 3/1974 |
| FR | 2695103 | | 3/1994 |
| GB | 2040884 | | 9/1980 |
| GB | 2268470 | | 1/1994 |

OTHER PUBLICATIONS

EP Extended European Search Report for EP App No. 15832564, dated Mar. 7, 2018 (7 pages).
International Preliminary Report on Patentability and Written Option for Intl App No. PCT 2015/045116 dated Feb. 14, 2017 (10 pages).
International Search Report for Intl App No. PCT 2015/045116 dated Nov. 9, 2015 (3 pages).

* cited by examiner

DISPLAY TRAY WITH SUPPORT COLUMN AND APERTURES

CROSS-REFERENCE TO RELATED APPLICATIONS

This application is a national stage application, filed under 35 U.S.C. § 371, of International Application No. PCT/US2015/045116, filed Aug. 13, 2015, which claims the benefit of GB Application No. 1414358.0, filed Aug. 13, 2014, entitled "DISPLAY TRAY WITH SUPPORT COLUMN AND APERTURES," both of which are incorporated herein by reference in their entirety for any and all purposes.

FIELD OF THE INVENTION

One or more embodiments of the present invention relate to a display tray that can be used to display consumer products in a retail environment.

BACKGROUND

Flat sheets of corrugated paperboard, typically referred to as blanks, have been used for many years as the starting material to form containers. Corrugated paperboard can take the form of multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard, or any other material that may be used instead of corrugated paperboard.

In shipping and displaying products, particularly in a retail setting, it is also desirable to have a container which is easy to pack, sturdy and suitable for display at a retail site. For example, it is beneficial to have a container configured to be convertible from a shipping configuration to a display configuration with minimal or no effort, preferentially permitting the container to be placed directly upon a shelf or floor display and itself serve as the display tray for the consumer product in the retail environment.

Such convertible containers represent a challenge in that they must be readily convertible into a form presentable to customers, while at the same time maintaining certain shipping performance characteristics, suitable for the shipment of non-self-supporting or even fragile products. Prior attempts at providing a displayable shipping container may suffer from one or more disadvantages. For example, prior displayable shipping containers often are either lacking in the necessary shipping performance characteristics or, in order to provide such performance, have structural elements that remain in position after converting to a display configuration that make access to the product inconvenient.

Other displayable shipping containers are labor intensive to manufacture, assemble, or convert. And still other containers require excessive materials or, in some cases, extraneous components (e.g., a tie or a wrap) to secure a lid on a body of the container. Once converted to a display configuration, many displayable shipping containers often also include rough, unfinished, jagged, and uneven surfaces in prominent locations that are somewhat unsightly and do not provide the appeal of a neat, clean and presentable display.

Because of the industry push to minimize the amount of corrugated paperboard or other starting material used to form a container and because of the desire to display a shipping container that is free of excessive structural elements, prior displayable containers tend to be somewhat weak, and in certain situations they can deform when stacked.

Therefore, it would be desirable to have a display tray that addresses many, if not all, of these disadvantages.

BRIEF SUMMARY OF THE INVENTION

One aspect of the present application provides an apparatus to display consumer products that includes a base that includes a bottom segment, at least two supporting segments, and a top segment, the top segment provided with a plurality of apertures and supported at least in part by the at least two supporting segments such that the bottom segment and the top segment are generally parallel. The apparatus further includes at least two side portions, at least one of the side portions including a support column, the at least two side portions being generally perpendicular to the bottom segment and the top segment.

In one embodiment, the top segment includes a cutout portion to receive the support column. The support column can take the form, for example, of a triangular or rectangular prism. One or more of the side portions can include a handle aperture to facilitate handling the apparatus. Alternatively, one or more of the side portions can include a perforated area adapted to provide a handle aperture upon applying pressure on or near said perforated area. According to one embodiment, at least one of the two side portions is reinforced, such as by folding a second extraneous segment onto the side portion. Alternatively, the second extraneous segment can be folded to provide a second support column.

In one embodiment, the apertures are generally in the shape of an ellipse or lens. For example, six or nine apertures can be provided per display tray. In one embodiment, the display tray can further include a lid supported at least in part by the at least two side portions. A portion of the lid can be affixed to one of the side portions in close proximity to the perforated area so that the lid is removed by applying pressure to the perforated area and removing a tear away zone.

The instantly described display tray can be assembled from a continuous source of the same material. These display trays are stackable, i.e., two or more trays can be stacked onto each other to provide a convenient and efficient display for consumer products.

A second aspect of the present invention provides a method of assembling an apparatus to display packaged products that includes providing a bottom segment, at least two supporting segments, a top segment with a plurality of apertures and a cutout portion, and at least two side portions, at least one of said at least two side portions containing an extraneous segment, folding the extraneous segment and affixing a portion of the folded extraneous segment onto a portion of one of the at least two side portions to form a support column, disposing the top segment above and parallel to the bottom segment by arranging the at least two supporting segments generally perpendicular to the top segment and the bottom segment, raising the at least two side portions such that the at least two side portions are perpendicular to the bottom segment and the top segment and the support column fits within the cutout portion of the top segment, and a) affixing the at least two side portions to an edge of the top segment and/or to an edge of one of the supporting segments, and/or b) affixing the bottom edges of the support column to the bottom segment.

In one embodiment, the extraneous segment is provided with at least two creases, and the extraneous segment is folded at the at least two crease to form the support column. One of the at least two creases can be generally aligned with an edge of the bottom segment. At least one of the at least two side portions can be further provided with a second extraneous segment, and the second extraneous segment can be folded onto one of the side portions to provide a reinforced side portion. Alternatively, the second extraneous segment can be provided with one or more creases and folded at the one or more creases to provide a second support column.

In one embodiment, the top segment is provided by initially providing a first top segment portion initially unattached to a second top segment portion, wherein the first top segment and second top segment are respectively joined with one of the supporting segments, and affixing a portion of the first top segment with a portion of the second top segment at a glue flange to thereby form the top segment.

In one embodiment, a lid is provided and at least one of the at least two side portions is provided with a perforated area, the lid being attached in close proximity to the perforated area such that upon tearing the perforated area and removing the lid, at least one of the at least two side portions is provided with a handle aperture.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE INVENTION

The display trays of the embodiments described herein are typically composed of corrugated paperboard, preferably with the corrugations running in a vertical direction for increased strength. As non-limiting examples, the containers may be composed of C-flute, EB-flute, E-flute or B-flute corrugated paperboard. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials.

FIGS. 1-7 show illustrative, non-limiting embodiments of the present invention, setting forth an exemplary method of preparing a display tray, and the display tray apparatus formed thereby. Certain terminology is used herein for convenience only and is not to be taken as a limitation on the present invention. While the following describes certain illustrative embodiments of the present invention, it should be understood, based on this disclosure that the invention is described by the claims, and is not limited by the embodiments described herein.

Figure 1A:
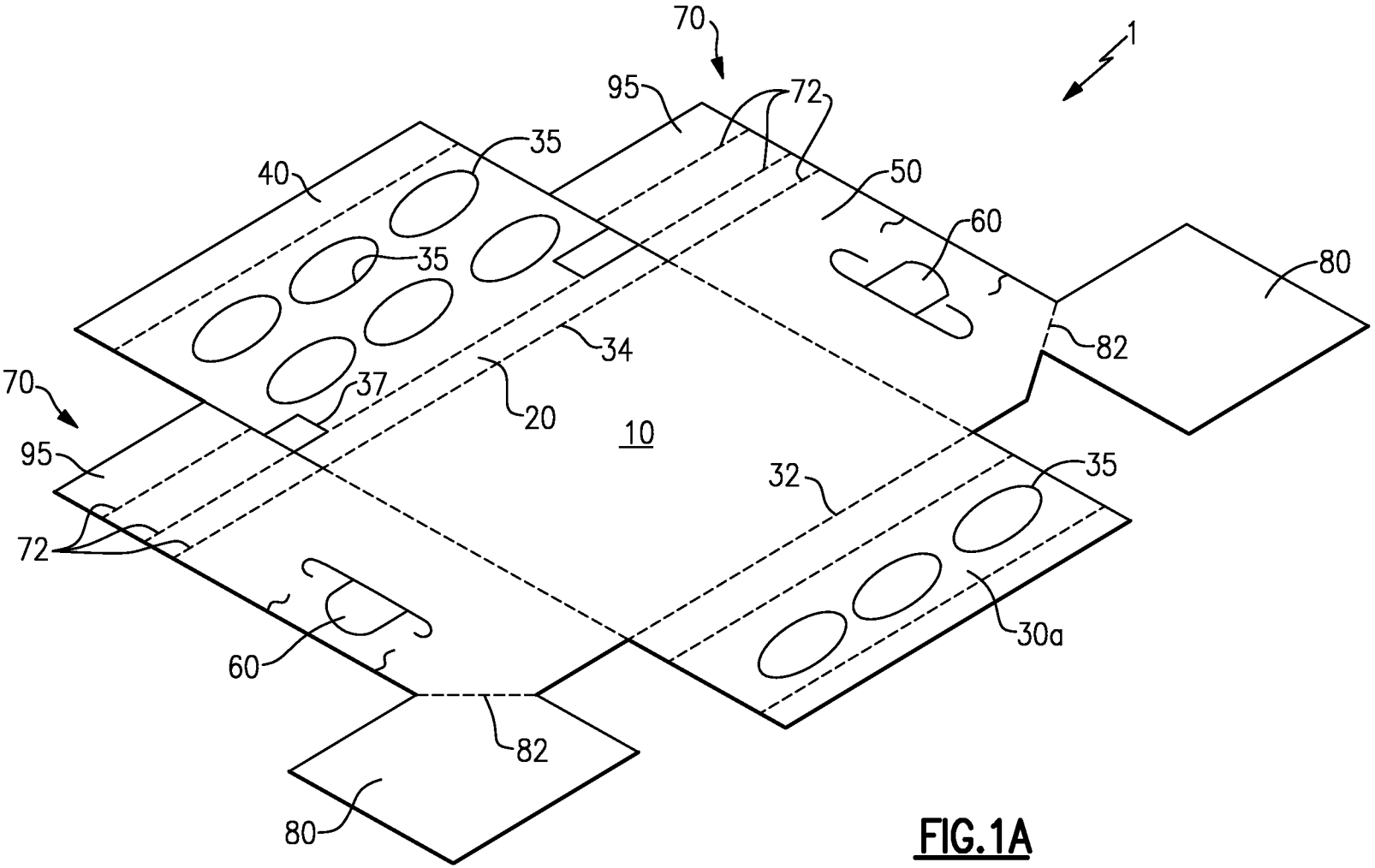
FIG. 1A is a perspective view of an example single layer sheet of material from which a display tray can be assembled.

FIG. 1A depicts the "flat pack" or unassembled display tray 1 according to an exemplary embodiment. The flat pack is composed of a single sheet of material (e.g., cardboard). This single sheet of material can be cut or otherwise manipulated to form a plurality of portions, which will define the display tray 1 once assembled. The single sheet of material of the flat pack defines a bottom segment, 10, which is a continuous piece of material without apertures, and which ultimately supports the consumer product in the display tray 1. The single sheet of material also defines two supporting segments, 20, as well as a first top portion 30*a* and a second top portion 30*b*. The first and second top portions 30*a*, 30*b* define apertures 35 and a cutout portion 37 which is sized to fit the support column discussed below.

With continued reference to FIG. 1, the single sheet of material also defines two side portions 50 which each include a handle aperture 60. Although the side portions 50 are shown here with pre-formed handling apertures, side portions 50 can alternatively be provided with a perforated area that is designed to be easily torn to provide a handling aperture. For example the side portions 50 can contain that perforated area that is an outline of, for example, a semi-circle such that tearing the side portion along the perforated edges creates a handling aperture in shape of a semi-circle.

With continued reference to FIG. 1, each side portion 50 also defines a support column segment 70 that, in this embodiment, is provided with three pre-formed creases. A side stiffener segment, 80 is also provided.

Figure 4:
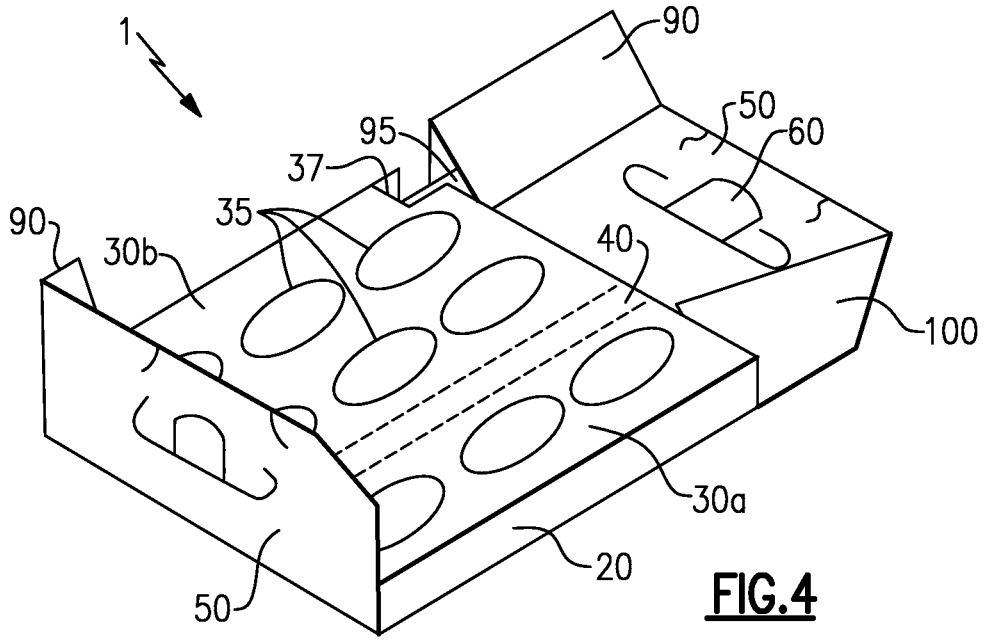
FIG. 4 is a perspective view of the display tray of FIG. 1 in a pre-assembled state in which one of the side portions is lifted and affixed.
Figure 5A:
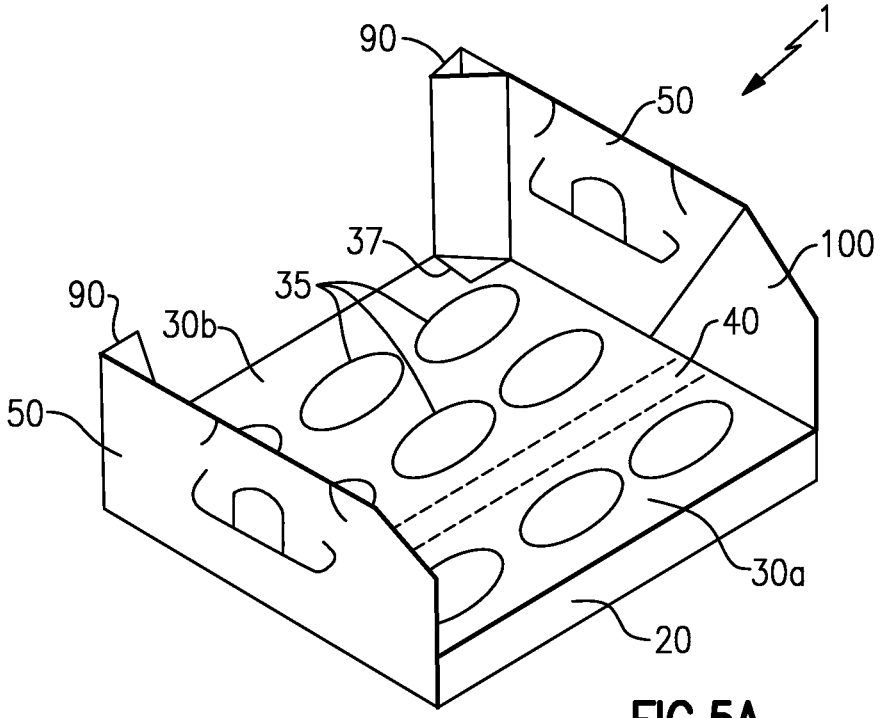
FIG. 5A is a perspective view of the display tray of FIG. 1 in an assembled state.

As referred to above, the flat pack form of the display tray 1 can be folded and various components can be attached together or otherwise made to contact one another to form an assembled display tray 1 as shown in FIG. 5A. FIGS. 1B-4 are perspective views of various stages in the assembly of the display tray 1. Although described in a particular order, the various stages in the assembly of the display tray 1 need not be performed in the same order described herein.

Figure 1B:
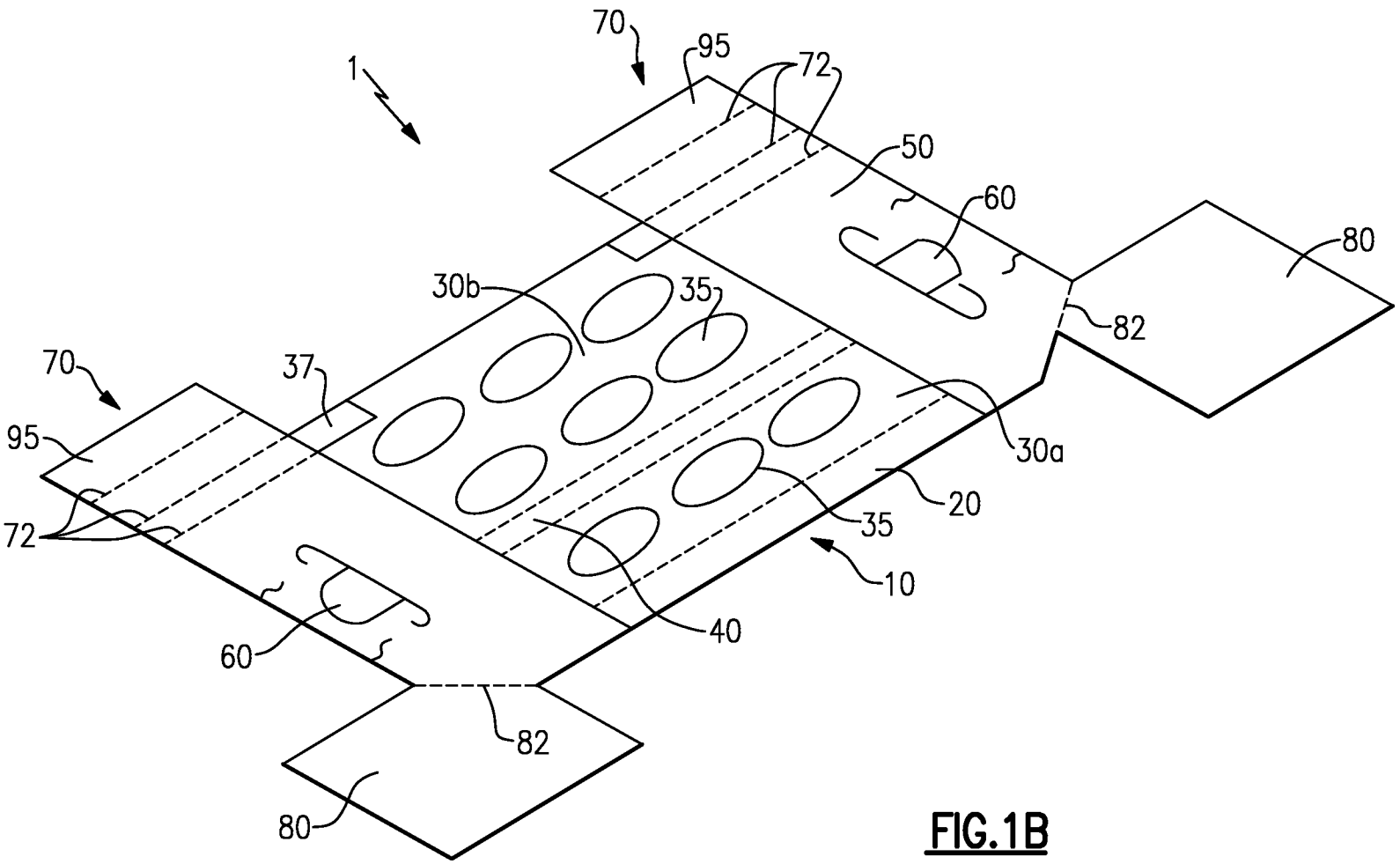
FIG. 1B is a perspective view of the display tray referenced in FIG. 1A in a pre-assembled state, in which a top segment is formed by attached two portions of the single layer together.

FIG. 1B is a perspective view of single sheet of material of the display tray 1, in which the first top portion 30*a* and the second top portion 30*b* are attached together to form the top portion of the display tray 1. To form the top portion of the display tray 1, the first top portion 30*a* and the second top portion 30*b* are folded inward along the creases 32 and 34 respectively. A respective glue flange portion 40 of each of the first top portion 30*a* and the second top portion 30*b* are overlapped with one another and attached together with, for example, an adhesive. In the assembled state of the display tray 1 (shown in FIG. 5A), the top segment is oriented in parallel with the bottom segment 10, and the supporting segments 20 are oriented generally perpendicular to the bottom segment 10 and the top segment.

Figure 2:
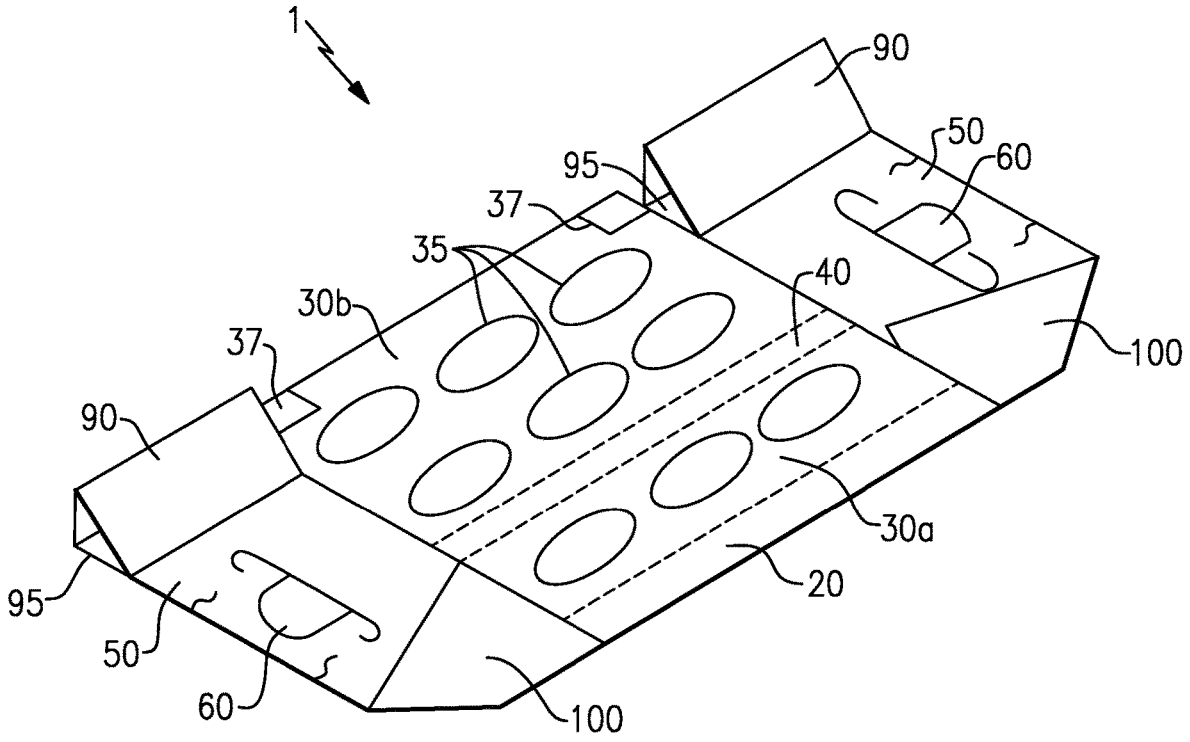
FIG. 2 is a perspective view of the display tray of FIG. 1 in a pre-assembled state in which a support column is formed.

With reference to FIG. 2, two support columns 90 are formed by folding the support column segments 70 at the pre-formed creases 72. Because three creases have been provided in this example, the support columns 90 in this embodiment have the shape of a triangular prism with three sides. The distal end of each support column segment 70 is glued or otherwise affixed to the corresponding side portion 50 so the integrity of the support column is maintained. Alternatively, or in addition, after a side portion 50 is raised as shown in FIG. 4, the lower edges of the support column 90 for that side portion 50 could be glued or otherwise affixed to the bottom segment 10.

Alternatively, for example, four creases can be provided in the extraneous segment, and the support column would thus take the form of a four-sided rectangular prism. In this case, the distal (fourth) side of the rectangular prism would be affixed to the side portion (or glued or otherwise affixed to the bottom segment).

As shown in FIG. 2, each of the side stiffener segments 80 can be folded, in this particular embodiment, along a respective crease 82 and glued to the corresponding side portion 50 to provide respective reinforced side portions 100. Alternatively, more than one crease can be provided in each side stiffener segment 80, and each side stiffener segment 80 can be folded as described above with respect to the (first) support column 90 to form a second support column (not shown). In this case, first portion 30*a* of the top segment can be provided with two second cutout portions similar to the cutout portions 37 in the second portion 30*b* of the top segment to make room for these second support columns.

Figure 3:
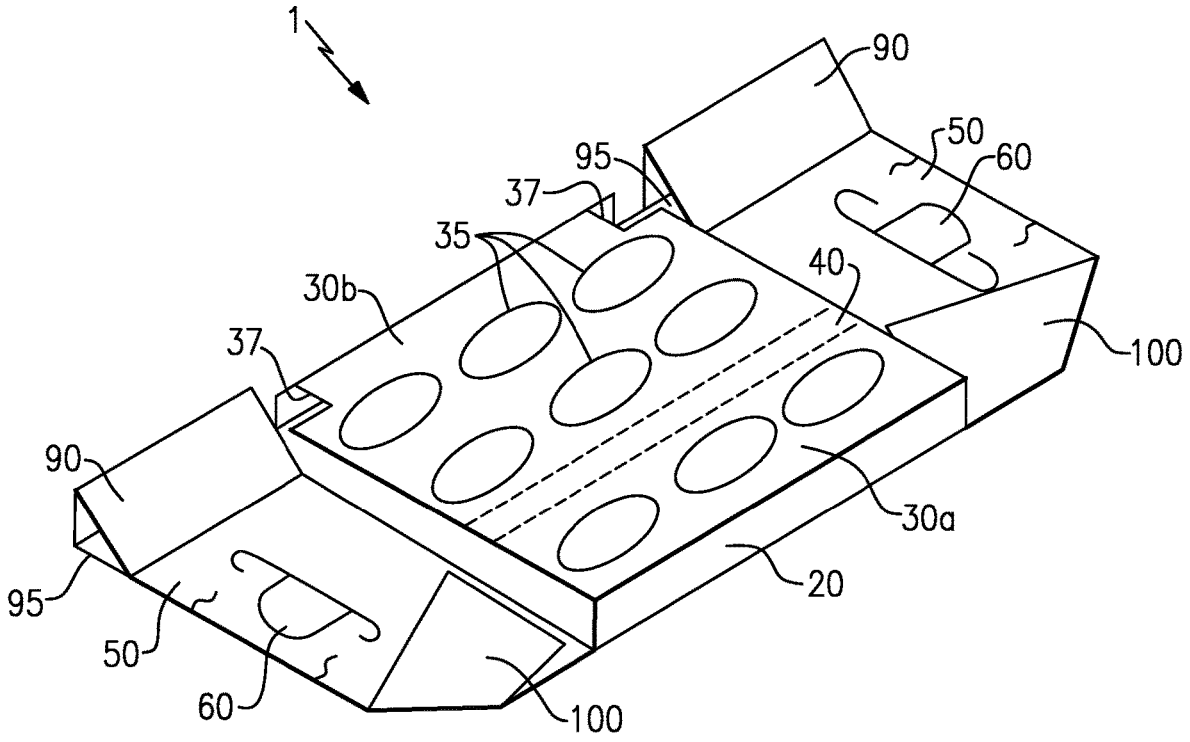
FIG. 3 is a perspective view of the display tray of FIG. 1 in a pre-assembled state in which the top segment is aligned parallel to the bottom segment via perpendicularly orienting the supporting segments.

With reference to FIG. 3, the single sheet of material is then manipulated to ensure that the top segment with apertures is generally parallel to the bottom segment 10 via perpendicularly orientated supporting segments 20. With reference to FIG. 4, the side portions 50 are then raised as shown and glued or otherwise affixed to the adjacent edges of the supporting segments 20 and/or top segment. Alternatively, or in addition, the lower edges of the support column 90 could be glued or otherwise affixed to the bottom segment 10, as noted above. As shown in FIG. 3, the cutout portion 37 is sized to receive the support column 90 upon being raised. Persons of ordinary skill can vary the size of the cutout portions 37 to accommodate various sizes and shapes of support columns 90, as the invention is not limited to the particular shapes shown in these Figures.

FIG. 5A is a perspective view of an example display tray 1 in the assembled state. Although not shown in FIG. 5A, a lid can also be provided to rest on the top edges of the side portions and enclose the tray 1, protecting the consumer products housed therein during shipment and pre-retail storage. In one embodiment, the lid is used in conjunction with side portions that contain a perforated area. A portion of the lid can be affixed in close proximity to this perforated area (e.g., attached at a location that is circumscribed by perforated edges) such that when the tray 1 arrives at the retail establishment, a worker can remove the lid by tearing the perforations and removing the tear-away zone. For example, the lid can be provided with a tear-away zone that, when applied to the tray 1, overlays with a tear-away zone on the side portion. The tear-away zone of the lid can be glued or otherwise affixed to a tear-away zone of the side portion. When a worker removes the tear away zones by applying pressure, he or she creates a handling aperture and also opens the lid to expose the consumer products in the tray 1 for immediate retail placement.

In the example shown in FIG. 5A, the apertures 35 are elliptical to accommodate a consumer product 100 having an elliptical base. In other examples, however, different sizes and shapes of apertures 35 can be provided depending on the consumer product that is to be displayed.

Figure 5B:
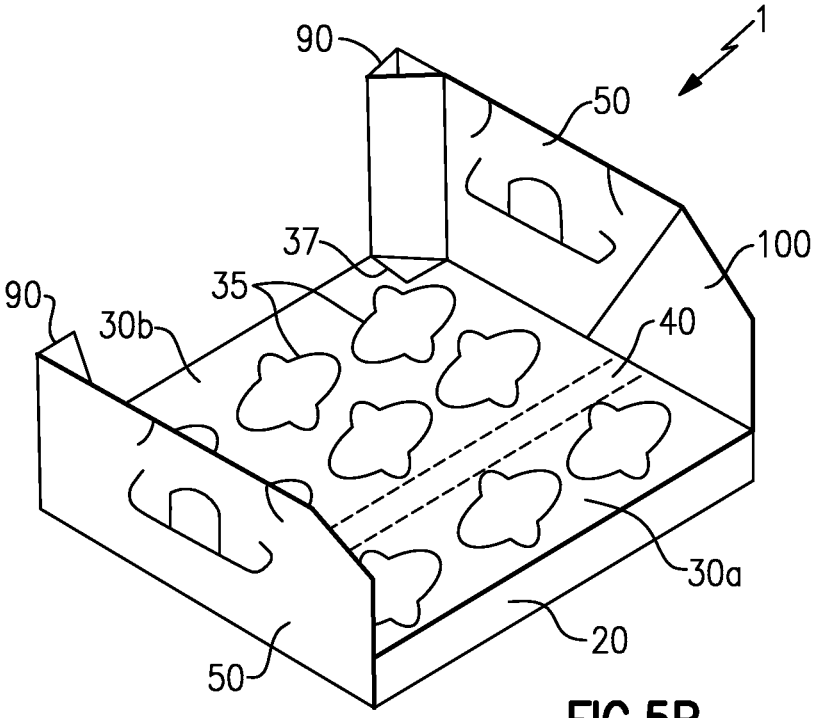
FIG. 5B is a perspective view of another example of a display tray in assembled state, in which each aperture on the top portion has a shape of two overlapping ellipses.

FIG. 5B is another example of an assembled display tray 1 in which each aperture 38 can have a shape of two overlapped ellipses. In the implementation of this example shown in FIG. 5B, the major axis of one overlapping ellipse is perpendicular to the major axis of the other overlapping ellipse. In other examples, respective orientations other than perpendicular (e.g., an acute angle) of the two overlapping ellipses can be used. Such a shape enables a consumer product having an elliptical base to be disposed in the display tray 1 in either of two orientations. A first orientation for the consumer product is achieved by aligning the elliptical base of the consumer product with a first of the overlapping ellipses. A second orientation is achieved by aligning the elliptical base of the consumer product with a second of the overlapping ellipses.

Additionally, in the example shown in FIG. 5B, the major axis of each of the ellipses cross at the center of the other major axis of the other ellipse, such that the two major axes generally form an "X". In other example, however, the major axis of one or both of the overlapping ellipses can cross the major axis of the other ellipse at other locations. In one such implementation the major axis of one overlapping ellipse crosses the major axis of the other overlapping ellipse closer to one of the major vertices of the other ellipse, such that the two major axes generally form a "T" or "t" shape.

Figure 5C:
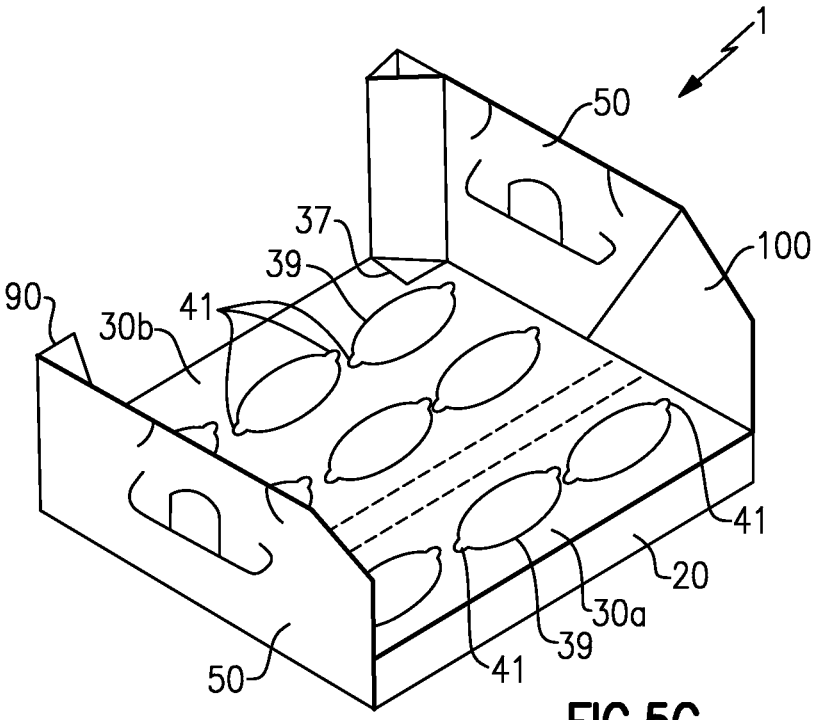
FIG. 5C is a perspective view of yet another example of a display tray in an assembled state, in which each aperture on the top portion has opposing notches defined in an ellipse shape.

FIG. 5C is another example of an assembled display tray 1 in which each aperture 39 can have an elliptical shape with two opposing notches 41, each notch 41 defined at a respective major vertice (that is, the vertice on the major axis) of the ellipse. The notches 41 can provide space for a seal portion of a consumer product. For example, the consumer product may comprise an upright bagged item formed of two vertical sides. The two vertical sides are each formed of a respective sheet of material, wherein the edges of the sheets of material are disposed flat against one another and attached together (for example, using an adhesive). The edges of the sheets that are attached to one another extend outward from a central portion in which the sheets are not attached together and form a pouch. The edges of the sheets that extend outward from the central portion are the seal portion referred to herein. Accordingly, such a consumer product can be placed in the apertures 39 of FIG. 5C by aligning the central "pouch" portion with the ellipse shape and aligning each of the two seal portions with a respective notch 41. Other shapes can also be used.

Figure 6:
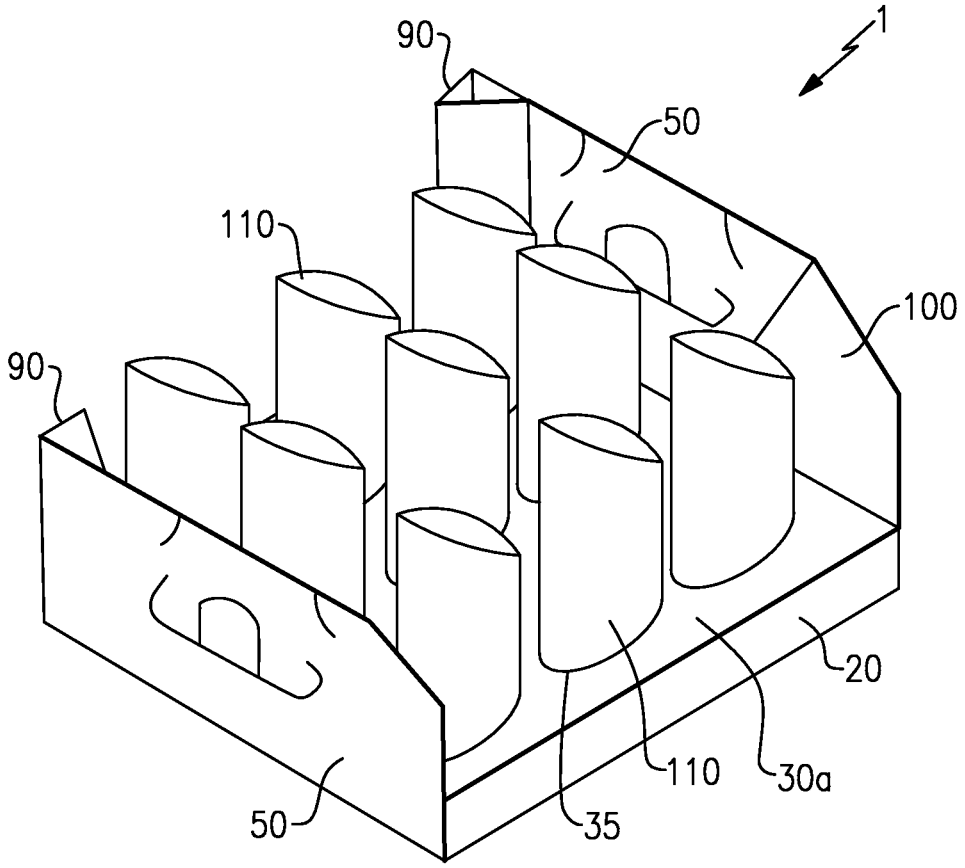
FIG. 6 is a perspective view of the display tray of FIG. 1 in an assembled state housing a consumer product.
Figure 7:
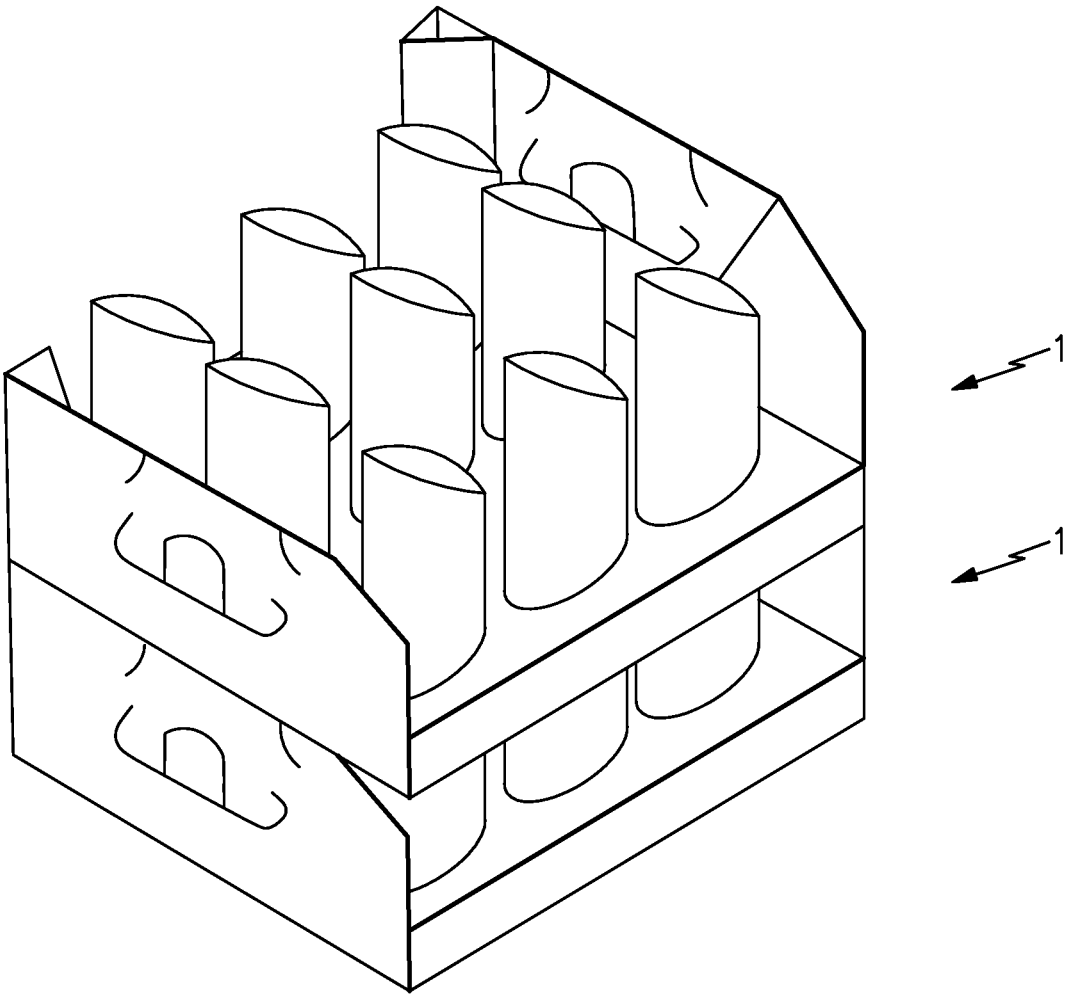
FIG. 7 is a perspective view of an example of multiple display trays in an assembled state in a stacked configuration.

With reference to FIG. 6, consumer products 110 are placed in the apertures of the top segment, and supported by the bottom segment 10. The consumer products 110, such as bagged candy, can be shipped to the retailer already in the tray 1 for immediate sale. As shown in FIGS. 6 and 7, consumer products have the shape of a lens, i.e., a biconvex shape comprising two circular arcs joined at their endpoints at least at an upper portion thereof.

As shown in FIG. 6, the filled trays 1 are configured to be stacked onto each other. Accordingly, each assembled display tray 1 is configured to support the weight of one or more display trays 1 on top thereof. For example, the inclusion of the support columns 90 and side stiffeners 80 provides increased vertical strength to the display tray 1 enabling one or more additional display trays 1 to be stacked thereon.

While this invention has been particularly shown and described with references to preferred embodiments thereof, it will be understood by those skilled in the art that various changes in form and details may be made therein without departing from the scope of the invention encompassed by the appended claims. Further, the embodiments included herein are given solely for the purpose of illustration and are not to be construed as limitations of the present invention, as many variations thereof are possible without departing from the spirit and scope of the invention.

The invention claimed is:

1. An apparatus to display consumer products comprising:

a base that includes a bottom segment, at least two supporting segments, and a top segment having a first top portion and a second top portion attached together to form said top segment, the top segment provided with a plurality of apertures and supported at least in part by the at least two supporting segments such that the bottom segment and the top segment are generally parallel, wherein the top segment includes a cutout portion to receive the support column and the support column is a triangular or rectangular prism; and at least two side portions, at least one of said side portions comprising a support column, the at least two side portions being generally perpendicular to the bottom segment and the top segment.

2. The apparatus of claim 1, wherein at least one of the at least two side portions further comprises a perforated area adapted to provide a handle aperture upon applying pressure on or near said perforated area.

3. The apparatus of claim 2, further comprising a lid, said lid supported at least in part by the at least two side portions, wherein a portion of the lid is affixed to at least one of the at least two side portions in close proximity to the perforated area.

4. The apparatus of claim 1, wherein at least one of the at least two side portions is reinforced.

5. The apparatus of claim 1, wherein the bottom segment, at least two supporting segments, top segment, and at least two side portions are assembled from a continuous piece of the same material.

6. The apparatus of claim 1, wherein the apertures are generally in the shape of an ellipse.

7. The apparatus of claim 1, wherein the plurality of apertures consists of six or nine apertures.

8. The apparatus of claim 1, further comprising at least one second extraneous segment connected with at least one of the at least two side portions, wherein the at least one second extraneous segment is folded at one or more creases to form a second support column.

9. The apparatus of claim 1, wherein each of the plurality of apertures has a shape of two overlapping ellipses, wherein a major axis of one of each overlapping ellipse crosses at a center of a major axis of its corresponding overlapping ellipse.

10. The apparatus of claim 9, wherein a major axis of one of each overlapping ellipse crosses near a major vertice of its corresponding overlapping ellipse.

11. The apparatus of claim 1, wherein each of the plurality of apertures has a shape of an ellipse with two notches, one notch at each major vertice of the ellipse.

12. An assembly to display packaged products comprising at least two apparatus comprising, a base that includes a bottom segment, at least two supporting segments, and a top segment having a first top portion and a second top portion attached together to form said top segment, the top segment provided with a plurality of apertures and supported at least in part by the at least two supporting segments such that the bottom segment and the top segment are generally parallel, wherein the first top portion and the second top portion each include a flange portion, wherein the flange portion of the first top portion and the flange portion of the second top portion overlap with one another; and at least two side portions, at least one of said side portions comprising a support column, the at least two side portions being generally perpendicular to the bottom segment and the top segment wherein the at least two apparatus are stacked.

13. The assembly of claim 12, wherein a consumer product is housed in at least one of the plurality of apertures.

14. The apparatus of claim 12, wherein at least one of the at least two side portions is reinforced.

15. The apparatus of claim 12, wherein the apertures are generally in the shape of an ellipse.

16. An apparatus to display consumer products comprising:

a base that includes a bottom segment, at least two supporting segments, and a top segment having a first top portion and a second top portion attached together to form said top segment, the top segment provided with a plurality of apertures and supported at least in part by the at least two supporting segments such that the bottom segment and the top segment are generally parallel, wherein the first top portion and the second top portion each include a flange portion, wherein the flange portion of the first top portion and the flange portion of the second top portion overlap with one another; and at least two side portions, at least one of said side portions comprising a support column, the at least two side portions being generally perpendicular to the bottom segment and the top segment.

17. The apparatus of claim 16, wherein at least one of the at least two side portions further comprises a perforated area adapted to provide a handle aperture upon applying pressure on or near said perforated area.

18. The apparatus of claim 16, wherein at least one of the at least two side portions is reinforced.

19. The apparatus of claim 16, wherein the bottom segment, at least two supporting segments, top segment, and at least two side portions are assembled from a continuous piece of the same material.

20. The apparatus of claim 16, wherein the apertures are generally in the shape of an ellipse.

* * * * *